US009922566B1

(12) United States Patent
Pereira

(10) Patent No.: US 9,922,566 B1
(45) Date of Patent: Mar. 20, 2018

(54) PASSING ZONE ADVISORY SYSTEMS AND METHODS

(71) Applicant: GM Global Technology Operations LLC, Detroit, MI (US)

(72) Inventor: Fabricio Pereira, Indaiatuba (BR)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/384,833

(22) Filed: Dec. 20, 2016

(51) Int. Cl.
*G08G 1/09* (2006.01)
*G08G 1/16* (2006.01)
*G08G 1/0967* (2006.01)

(52) U.S. Cl.
CPC ..... *G08G 1/167* (2013.01); *G08G 1/0967* (2013.01)

(58) Field of Classification Search
CPC ..... G08G 1/167; G08G 1/0967
USPC ..... 340/905
See application file for complete search history.

(56) References Cited

U.S. PATENT DOCUMENTS 7,027,917 B2 * 4/2006 Ikeda ..... G08G 1/096716 340/435
8,344,864 B1 * 1/2013 Al-Mutawa ..... B60W 50/12 340/435
8,427,341 B2 * 4/2013 Yulevich ..... G08G 1/096783 340/901
9,539,901 B1 * 1/2017 Clauss ..... B60K 31/18
9,607,513 B1 * 3/2017 Williams ..... G08G 1/09
2004/0059501 A1 * 3/2004 Ikeda ..... G08G 1/096716 701/431
2006/0142941 A1 * 6/2006 Imai ..... G01C 21/3638 701/431
2012/0245756 A1 * 9/2012 Cooprider ..... B60W 30/146 701/1
2015/0148985 A1 * 5/2015 Jo ..... G08G 1/096725 701/1
2016/0170487 A1 * 6/2016 Saisho ..... G01C 21/3635 345/156
2016/0231746 A1 * 8/2016 Hazelton ..... G05D 1/0212
2016/0311323 A1 * 10/2016 Lee ..... B60K 37/06
2016/0313562 A1 * 10/2016 Saisho ..... G02B 27/0179
2016/0347318 A1 * 12/2016 Yoshitomi ..... B60W 30/18009
2017/0008521 A1 * 1/2017 Braunstein ..... G01C 21/32
2017/0101058 A1 * 4/2017 Park ..... B60R 1/081
2017/0182934 A1 * 6/2017 Arita ..... B60Q 1/503

* cited by examiner

*Primary Examiner* — Kerri McNally
*Assistant Examiner* — Thang Tran

(57) ABSTRACT

A road type module, based on a present location of the vehicle, determines whether the vehicle is traveling on a single lane road. The single lane road includes passing zones and no passing zones. The single lane road has only a first lane designated for travel in one direction and a second lane designated for travel in an opposite direction. A passing zone module, when the vehicle is traveling on the single lane road, determines whether the vehicle is located in one of the passing zones or in one of the no passing zones. A display module selectively displays at least one of: a driving distance to a next one of the passing zones on the single lane road in a direction of travel of the vehicle; and an estimated driving period to the next one of the passing zones.

18 Claims, 3 Drawing Sheets

PASSING ZONE ADVISORY SYSTEMS AND METHODS

FIELD

The present disclosure relates to vehicles and more particularly systems and methods of displaying passing zone information to vehicle occupants.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Vehicles generally travel on roads, but can also travel off-road. Paved roads often include one or more lanes for travel in each direction. For example, some lanes have two or more lanes for travel in each direction. When traveling on roads with two or more lanes of travel in a direction, slower moving traffic often stays toward one side of the road (e.g., the right in the United States), which allows faster moving traffic to pass the slower moving traffic.

Single lane roads, however, include only one lane for travel in each direction. To pass a slower moving vehicle traveling in the same direction on a single lane road, the passing vehicle passes the slower moving vehicle using the lane for travel in the opposite direction. Single lane roads therefore may include dedicated passing zones where passing is allowed and dedicated no passing zones where passing is not allowed.

SUMMARY

In a feature, a passing zone display system of a vehicle includes a road type module that, based on a present location of the vehicle, determines whether the vehicle is traveling on a single lane road, the single lane road including passing zones and no passing zones, and the single lane road having only two lanes for vehicles, the two lanes including a first lane designated for travel in one direction and a second lane designated for travel in an opposite direction. A passing zone module, when the vehicle is traveling on the single lane road, based on the present location of the vehicle determines whether the vehicle is located in one of the passing zones or in one of the no passing zones. A display module, when the vehicle is in one of the no passing zones on the single lane road, selectively displays, on a display located within a passenger cabin of the vehicle, at least one of: a driving distance to a next one of the passing zones on the single lane road in a direction of travel of the vehicle; and an estimated driving period to the next one of the passing zones on the single lane road in the direction of travel of the vehicle.

In further features, the display module displays the at least one of the driving distance and the estimated driving period in response to receipt of user input to display the at least one of the driving distance and the estimated driving period while the vehicle is in the one of the no passing zones on the single lane road.

In further features, an input module generates the user input in response to user touching of the display.

In further features, the display module displays the at least one of the driving distance and the estimated driving period in response to the driving distance being less than a predetermined driving distance while the vehicle is in the one of the no passing zones on the single lane road.

In further features, the display module displays the at least one of the driving distance and the estimated driving period in response to the estimated driving period being less than a predetermined period while the vehicle is in the one of the no passing zones on the single lane road.

In further features, the display module displays the at least one of the driving distance and the estimated driving period in response to the vehicle entering the one of the no passing zones on the single lane road and a driving length of the one of the no passing zones being greater than a predetermined distance.

In further features, the display module displays the at least one of the driving distance and the estimated driving period in response to the vehicle entering the one of the no passing zones on the single lane road and the driving distance is greater than a predetermined distance.

In further features, the display module displays the at least one of the driving distance and the estimated driving period in response to the vehicle entering the one of the no passing zones on the single lane road and the estimated driving period is greater than a predetermined period.

In further features, when the vehicle is in the one of the no passing zones on the single lane road, the display module selectively displays, on the display located within the passenger cabin of the vehicle, at least one of: a second driving distance to a location where the single lane road turns into a road having two or more lanes for travel in the direction of travel of the vehicle; and a second estimated driving period to the location where the single lane road turns into a road having two or more lanes for travel in the direction of travel of the vehicle.

In further features, the display module displays both: the driving distance to the location of the next one of the passing zones on the single lane road in the direction of travel of the vehicle; and the estimated driving period to the location of the next one of the passing zones on the single lane road in the direction of travel of the vehicle.

In a feature, a passing zone display method includes: based on a present location of the vehicle, determining whether the vehicle is traveling on a single lane road, the single lane road including passing zones and no passing zones, and the single lane road having only two lanes for vehicles, the two lanes including a first lane designated for travel in one direction and a second lane designated for travel in an opposite direction; when the vehicle is traveling on the single lane road, based on the present location of the vehicle, determining whether the vehicle is located in one of the passing zones or in one of the no passing zones; and, when the vehicle is in one of the no passing zones on the single lane road, selectively displaying, on a display located within a passenger cabin of the vehicle, at least one of: a driving distance to a next one of the passing zones on the single lane road in a direction of travel of the vehicle; and an estimated driving period to the next one of the passing zones on the single lane road in the direction of travel of the vehicle.

In further features, the selectively displaying includes displaying the at least one of the driving distance and the estimated driving period in response to receipt of user input to display the at least one of the driving distance and the estimated driving period while the vehicle is in the one of the no passing zones on the single lane road.

In further features, the passing zone display method further includes generating the user input in response to user touching of the display.

In further features, the selectively displaying includes displaying the at least one of the driving distance and the estimated driving period in response to the driving distance being less than a predetermined driving distance while the vehicle is in the one of the no passing zones on the single lane road.

In further features, the selectively displaying includes displaying the at least one of the driving distance and the estimated driving period in response to the estimated driving period being less than a predetermined period while the vehicle is in the one of the no passing zones on the single lane road.

In further features, the selectively displaying includes displaying the at least one of the driving distance and the estimated driving period in response to the vehicle entering the one of the no passing zones on the single lane road and a driving length of the one of the no passing zones being greater than a predetermined distance.

In further features, the selectively displaying includes displaying the at least one of the driving distance and the estimated driving period in response to the vehicle entering the one of the no passing zones on the single lane road and the driving distance is greater than a predetermined distance.

In further features, the selectively displaying includes displaying the at least one of the driving distance and the estimated driving period in response to the vehicle entering the one of the no passing zones on the single lane road and the estimated driving period is greater than a predetermined period.

In further features, the passing zone display method further includes, when the vehicle is in the one of the no passing zones on the single lane road, selectively displaying, on the display located within the passenger cabin of the vehicle, at least one of: a second driving distance to a location where the single lane road turns into a road having two or more lanes for travel in the direction of travel of the vehicle; and a second estimated driving period to the location where the single lane road turns into a road having two or more lanes for travel in the direction of travel of the vehicle.

In further features, the selectively displaying includes displaying both: the driving distance to the location of the next one of the passing zones on the single lane road in the direction of travel of the vehicle; and the estimated driving period to the location of the next one of the passing zones on the single lane road in the direction of travel of the vehicle.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A navigation system of a vehicle generally displays a vehicle location on a display within a passenger cabin of the vehicle. The navigation system may also display roads and/or other features that are within a predetermined area, such as within the predetermined area centered at the vehicle location. A user may increase or decrease the predetermined area, for example, to provide less detailed information or more detailed information, respectively.

Some roads are single lane roads having one lane for vehicle travel in each direction. On a single lane road, passing is only allowed in designated passing zones. Passing is not allowed outside of designated passing zones (i.e., in no passing zones) on single lane roads. On single lane roads, a driver utilizes the lane designated for vehicle travel in the opposite direction to pass one or more slower moving vehicles traveling in the lane designated for vehicle travel in the same direction as the driver's vehicle.

Some geographical areas have more single lane roads than others. For example, over 90 percent of all of the paved roads in the country of Brazil are single lane roads. Drivers may attempt to pass despite being within a no passing zone when stuck behind a slower moving vehicle (e.g., a truck) on a single lane road.

According to the present disclosure, the navigation system determines a location of a next (closest) passing zone on the single lane road that the vehicle is currently traveling on. When in a no passing zone, the navigation system selectively displays a distance or estimated period until the vehicle will reach the next passing zone.

The navigation system may display the distance or estimated period to the next passing zone, for example, in response to receipt of user input indicative of a request for the distance or estimated period to the next passing zone. Additionally or alternatively, the navigation system may display the distance or estimated period when the vehicle is within a no passing zone that is longer than a predetermined distance or period, when the vehicle is behind a vehicle on a single lane road for a predetermined period, and/or when the distance or estimated period to the next passing zone becomes less than a predetermined distance or period. Based on the knowledge of the distance or estimated period to the next passing zone, the driver may refrain from attempting to pass in no passing zones.

Figure 1:
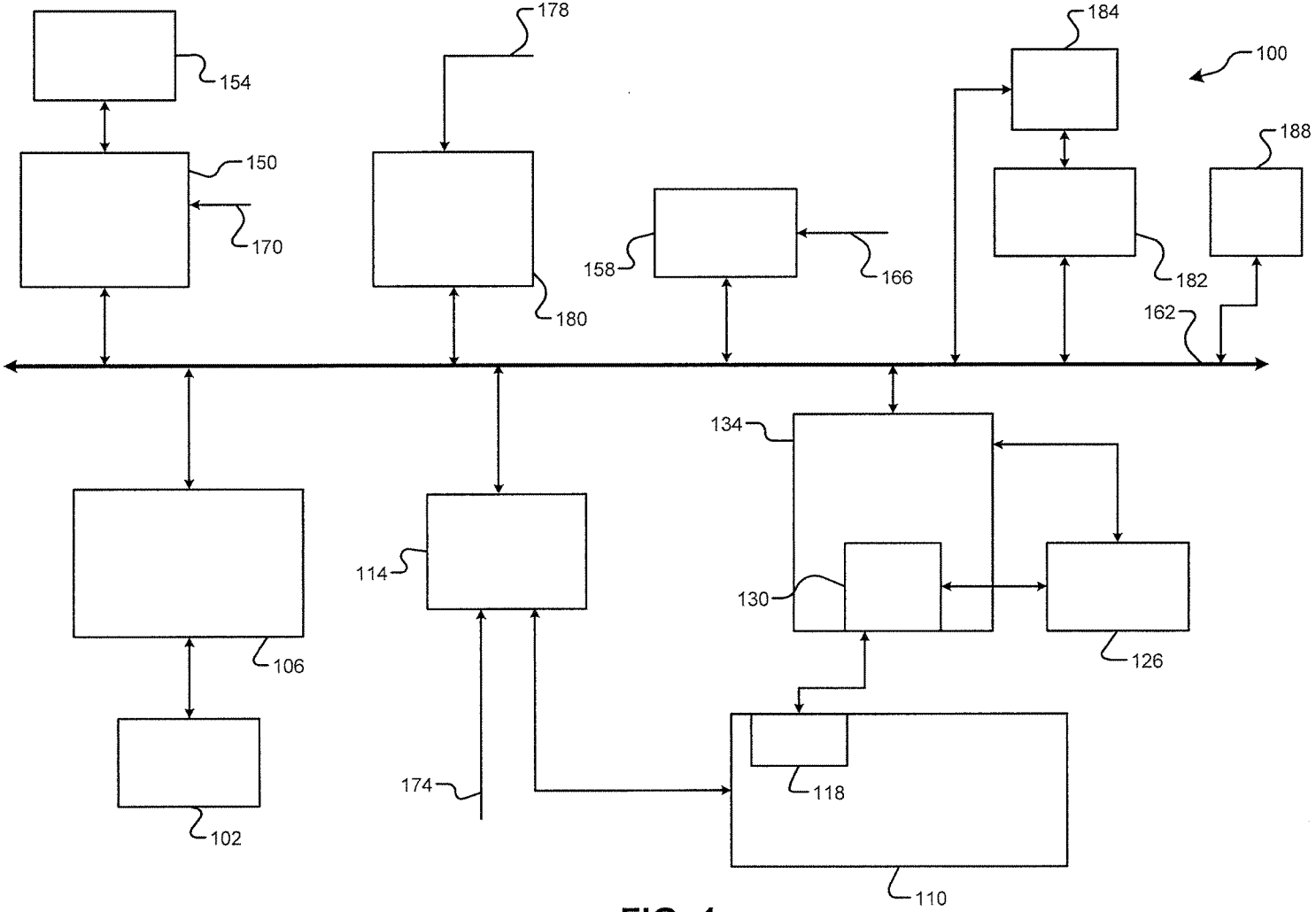
FIG. 1 is a functional block diagram of an example vehicle system.

Referring now to FIG. 1, a functional block diagram of an example vehicle system 100 is presented. While a vehicle system for a hybrid vehicle is shown and will be described, the present disclosure is also applicable to non-hybrid vehicles, electric vehicles, fuel cell vehicles, autonomous vehicles, and other types of vehicles.

An engine 102 combusts an air/fuel mixture to generate drive torque. An engine control module (ECM) 106 controls the engine 102. For example, the ECM 106 may control actuation of engine actuators, such as a throttle valve, one or more spark plugs, one or more fuel injectors, valve actuators, camshaft phasers, an exhaust gas recirculation (EGR) valve, one or more boost devices, and other suitable engine actuators.

The engine 102 may output torque to a transmission 110. A transmission control module (TCM) 114 controls operation of the transmission 110. For example, the TCM 114 may control gear selection within the transmission 110 and one or more torque transfer devices (e.g., a torque converter, one or more clutches, etc.).

The vehicle system 100 may include one or more electric motors. For example, an electric motor 118 may be implemented within the transmission 110 as shown in the example of FIG. 1. An electric motor can act as either a generator or as a motor at a given time. When acting as a generator, an electric motor converts mechanical energy into electrical energy. The electrical energy can be, for example, used to charge a battery 126 via a power control device (PCD) 130. When acting as a motor, an electric motor generates torque that may be used, for example, to supplement or replace torque output by the engine 102. While the example of one electric motor is provided, the vehicle may include zero or more than one electric motor.

A power inverter control module (PIM) 134 may control the electric motor 118 and the PCD 130. The PCD 130 applies (e.g., direct current) power from the battery 126 to the (e.g., alternating current) electric motor 118 based on signals from the PIM 134, and the PCD 130 provides power output by the electric motor 118, for example, to the battery 126. The PIM 134 may be referred to as a power inverter module (PIM) in various implementations.

An electronic brake control module (EBCM) 150 may selectively control brakes 154 of the vehicle. A user interface module (UIM) 158 may provide one or more driver inputs to a controller area network (CAN) 162. The CAN 162 may also be referred to as a car area network. For example, the CAN 162 may include one or more data buses. Various parameters read by a given control module may be made available to other control modules via the CAN 162.

The driver inputs may include, for example, an accelerator pedal position (APP) 166. A brake pedal position (BPP) 170 may be provided to the EBCM 150. A position 174 of a park, reverse, neutral, drive lever (PRNDL) may be provided to the TCM 114. An ignition state 178 may be provided to a body control module (BCM) 180. For example, the ignition state 178 may be input by a driver via an ignition key, button, or switch. At a given time, the ignition state 178 may be one of off, accessory, run, or crank.

The vehicle system 100 also includes a navigation module 182. The navigation module 182 may include a global position system (GPS) that determines a location of the vehicle. The navigation module 182 may, on a display 184, display a map including one or more roads and the location of the vehicle. The navigation module 182 may also receive inputs and display other things, such as video and/or images captured using one or more vehicle surroundings sensors. One example vehicle surrounding sensors includes a forward facing camera 188 that captures images of in front of the vehicle. While the example of the forward facing camera 188 is shown, the vehicle may include other types of vehicle surroundings sensors, such as side rear view cameras, backward facing cameras, sonar sensors, radar sensors, LIDAR sensors, etc.

The vehicle may include one or more additional control modules that are not shown, such as a chassis control module, a battery pack control module, etc. The vehicle may omit one or more of the control modules shown and discussed.

Figure 2:
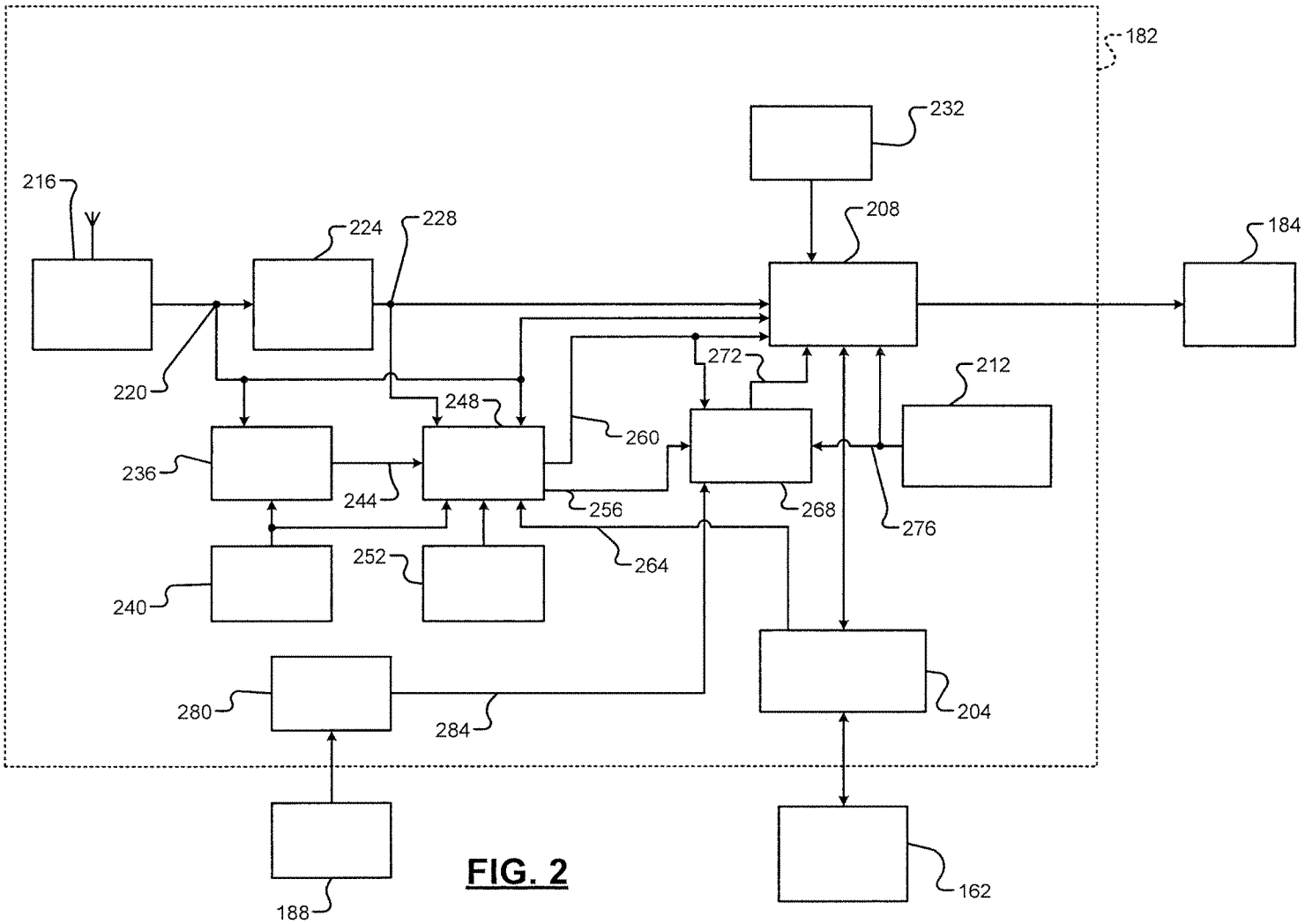
FIG. 2 is a functional block diagram of an example navigation module.

Referring now to FIG. 2, a functional block diagram of an example implementation of the navigation module 182 is presented. The navigation module 182 includes a communication module 204 that communicates with other modules of the vehicle via the CAN 162.

A display module 208 displays images and video on the display 184 and receives user input for what to display on the display 184 via an input module 212. The display module 208 may display images, video, overlays, data, etc. based on the user input. In various implementations, the display 184 may be a touchscreen display and transmit signals to the input module 212. In the example of the display 184 being a touch screen display, the input module 212 generates signals indicative of user input to the display 184. Additionally or alternatively, the input module 212 may generate signals indicative of user input further based on signals from one or more other user input devices, such as one or more buttons, switches, knobs, etc.

A GPS module 216 determines a location 220 of the vehicle ("vehicle location") based on signals from a satellite system received via one or more antennas. The vehicle location 220 may include, for example, coordinates (e.g., longitude and latitude) of the vehicle. The GPS module 216 may update the vehicle location 220, for example, each predetermined period. While the example of GPS location based vehicle location is provided, the vehicle location may be obtained in another way, such as wirelessly from terrestrial wireless networks or wirelessly from a mobile device, such as a cell phone.

A heading module 224 determines a heading 228 of the vehicle ("vehicle heading"). For example, the heading module 224 may determine the vehicle heading 228 based on a change between consecutive instances of the vehicle location 220. As another example, the heading module 224 may determine the vehicle heading 228 based on signals from a compass of the vehicle. The vehicle heading 228 may be, for example, North, North East, East, South East, South, South West, West, or North West.

The display module 208 may display a map on the display 184 based on the vehicle location 220. For example, the display module 208 may display a map including features, such as roads and other points of interest, located within a predetermined area centered at the vehicle location 220. The display module 208 may also display an indicator of the vehicle on the map with the indicator pointing in a direction of the vehicle heading 228. In various implementations, the predetermined area may be centered at another location different than the vehicle location 220. For example, a different center location may be used in response to user input. The predetermined area may be in terms of one or more straight line distances from a center location. In various implementations, the one or more straight line distances may be varied, for example, in response to user input. The display module 208 may determine the features to include on the map using data stored in a mapping database 232. The mapping database 232 may include, for example, data indicative of locations for roads, points of interest, and other features, respectively.

A road type module 236 determines whether the vehicle is currently located on a single lane road. The road type module 236 may determine whether the vehicle is currently located on a single lane road, for example, based on the vehicle location 220 using data stored in a road database 240. The road database 240 may include a listing of locations (e.g., coordinates) and associated indicators of whether roads at the locations, respectively, are single lane roads or not. Single lane roads have one lane for traffic travelling in each direction. An example listing is provided below.

| Location (e.g., Latitude, Longitude) | Indicator of Whether Single Lane Road at Location |
|---|---|
| (Lat 1, Long 1) | Y |
| (Lat 2, Long 2) | N |
| (Lat 3, Long 3) | N |
| . | |
| . | |
| . | |
| (Lat X, Long X) | Y |

X corresponds to a total number of entries of the listing. In various implementations, the road database 240 may be implemented together with the mapping database 232.

The road type module 236 indicates whether the vehicle is currently located on a single lane road via a road signal 244. For example, the road type module 236 may set the road signal 244 to a first state when the vehicle is currently located on a single lane road. The road type module 236 may set the road signal 244 to a second state when the vehicle is not currently located on a single lane road.

When the vehicle is currently located on a single lane road (e.g., when the road signal 244 is in the first state), a passing zone module 248 determines whether the vehicle is currently located in a passing zone or in a no passing zone. The passing zone module 248 may determine whether the vehicle is currently located in a passing zone or in a no passing zone, for example, based on the vehicle location 220 using data stored in a passing zone database 252. The passing zone database 252 may include a listing of locations (e.g., coordinates) and associated indicators of whether passing is allowed (i.e., passing zone) or not (i.e., no passing zone) on the single lane roads at the locations, respectively. An example listing is provided below.

| Location (e.g., Latitude, Longitude) | Indicator of Whether Passing Zone on Single Lane Road at Location |
|---|---|
| (Lat 1, Long 1) | Y |
| (Lat 2, Long 2) | N |
| (Lat 3, Long 3) | N |
| . | |
| . | |
| . | |
| (Lat W, Long W) | Y |

W corresponds to a total number of entries of the listing. In various implementations, the passing zone database 252 may be implemented together with the road database 240 and/or the mapping database 232. Zones may refer to stretches of road between end points. For example, a passing zone may refer to a stretch of road between two locations where passing (utilizing the lane designated for vehicle travel in the opposite direction) is allowed between the two locations according to traffic laws. A no passing zone may refer to a stretch of road between two locations where passing is not allowed according to traffic laws.

The passing zone module 248 indicates whether the vehicle is currently located in a passing zone (on a single lane road) via a passing zone signal 256. For example, the passing zone module 248 may set the passing zone signal 256 to a first state when the vehicle is currently located in a passing zone. The passing zone module 248 may set the passing zone signal 256 to a second state when the vehicle is currently located in a no passing zone.

When the vehicle is currently in a no passing zone on a single lane road, the passing zone module 248 determines a location of a next passing zone on the single lane road that the vehicle is on in the direction that the vehicle is heading. The next passing zone is the closest passing zone to the vehicle on the single lane road in the direction that the vehicle is traveling. The next passing zone may be a designated passing zone or where the single lane road transitions to a non-single lane road having two or more lanes designated for travel in the same direction as the vehicle is travelling.

For example, the passing zone module 248 may determine the location of the next passing zone based on the vehicle location 220 and the vehicle heading 228 using data stored in the passing zone database 252. The passing zone database 252 may also include a listing of locations (e.g., coordinates) of endpoints (e.g., start and end locations) of passing zones indexed by single lane road. An example listing is provided below.

| Single Lane Road | Location (e.g., Latitude, Longitude) of End Points of Passing Zone |
|---|---|
| Road 1 | Endpoint 1 (Lat 1, Long 1), Endpoint 2 (Lat 2, Long 2) |
| Road 1 | Endpoint 3 (Lat 3, Long 3), Endpoint 4 (Lat 4, Long 4) |
| . | . |
| . | . |
| . | . |
| Road 2 | Endpoint M (Lat M, Long M), Endpoint M + 1 (Lat M + 1, Long M + 1) |
| . | . |
| . | . |
| . | . |
| Road Q | Endpoint Z-1 (Lat 1, Long 1), Endpoint Z (Lat 2, Long 2) |

Q corresponds to a total number of roads in the listing. M is an integer greater than 1. Z corresponds to a total number of endpoints in the listing.

Using data stored in the passing zone database 252, the passing zone module 248 may identify the locations of all of the passing zones that on the single lane road that the vehicle is currently on. From these locations, the passing zone module 248 may select one of the locations (endpoints) that is closest to the vehicle location 220 given the vehicle heading 228 on the single lane road. The selected one of the locations is the location where the vehicle will next enter a passing zone on the single lane road. The location where the vehicle will next enter a passing zone at a given time will be referred to as the location of the next passing zone.

When the vehicle is currently in a no passing zone on a single lane road, the passing zone module 248 determines next passing zone data 260 based on the location of the next passing zone. The next passing zone data 260 may include a driving distance (via the single lane road) to the location of the next passing zone and/or an estimated travel period (from the present time) until the vehicle will reach the location of the next passing zone. The passing zone module 248 may determine the driving distance, for example, based on the driving distance between the vehicle location 220 and the location of the next passing zone. The passing zone module 248 may determine the estimated travel period to the location of the next passing zone, for example, based on the driving distance to the location of the next passing zone and a vehicle speed 264. For example, the passing zone module 248 may set the estimated travel period based on or equal to the driving distance divided by the vehicle speed 264. The vehicle speed 264 may be measured, for example, using one or more wheel speed sensors of the vehicle. For example, the ECM 106 may set the vehicle speed 264 based on or equal to an average of one or more of the measured wheel speeds. Driving distances are different than straight line distances. While the GPS module 216, the heading module 224, the road type module 236, and the passing zone module 248 are shown and discussed as being implemented within the navigation module 182, part or all of the functionality of the GPS module 216, the heading module 224, the road type module 236, and the passing zone module 248 (and the associated databases used) may be implemented remotely from the vehicle (e.g., at one or more remote servers) and the respective data may be transmitted wirelessly to the vehicle.

A triggering module 268 selectively triggers the display module 208 to display the next passing zone data 260 via a display signal 272. For example, the triggering module 268 may set the display signal 272 to a first state to trigger the display module 208 to display the next passing zone data 260. The display module 208 displays the next passing zone data 260, such as the driving distance to the next passing zone and/or the estimated travel period until the vehicle will reach the next passing zone on the display 184 when the display signal 272 is in the first state. The display module 208 may not display the next passing zone data 260 on the display 184 when the display signal 272 is in a second state.

The triggering module 268 may set the display signal 272 to the first state, for example, in response to a user input request 276 to display the next passing zone data 260. Additionally or alternatively, the triggering module 268 may set the display signal 272 to the first state each time that the vehicle enters a no passing zone on a single lane road. In various implementations, the triggering module 268 may set the display signal 272 to the first state each time that the vehicle enters a no passing zone of at least a first predetermined driving distance and/or a first predetermined travel period. For example only, the first predetermined driving distance may be approximately 15 miles or another suitable distance and the first predetermined travel period may be approximately 15 minutes or another suitable period of travel. The driving distances of no passing zones may also be stored in the passing zone database 252 and determined from the passing zone database 252.

Additionally or alternatively to the above, the triggering module 268 may set the display signal 272 to the first state when the driving distance to the next passing zone is less than a second predetermined driving distance and/or the estimated travel period to the next passing zone is less than a second predetermined period. For example only, the second predetermined driving distance may be approximately 5 miles or another suitable distance that is less than the first predetermined driving distance and the second predetermined travel period may be approximately 5 minutes or another suitable period of travel that is less than the first predetermined travel period.

Additionally or alternatively to the above, the triggering module 268 may set the display signal 272 to the first state when the vehicle has traveled for at least a third predetermined period behind another vehicle on a single lane road. The third predetermined period may be, for example, approximately 10 minutes or another suitable period of travel.

A vehicle detection module 280 may determine whether the vehicle is traveling behind another vehicle, for example, using images captured using the forward facing camera 188. For example, the vehicle detection module 280 may determine that the vehicle is traveling behind another vehicle when an image captured using the forward facing camera 188 includes a predetermined shape of a vehicle. While the example of use of the forward facing camera 188 is provided, the vehicle detection module 280 may determine whether the vehicle is traveling behind another vehicle via signals from one or more other forward facing sensors, such as a forward facing radar, sonar, or LIDAR sensor. The vehicle detection module 280 tracks a period that the vehicle is traveling behind another vehicle on a single lane road and may set a trailing signal 284 to a first state when the vehicle has traveled behind another vehicle for at least the third predetermined period continuously. Otherwise, the vehicle detection module 280 may set the trailing signal 284 to a second state. In various implementations, the vehicle detection module 280 may track the period that the vehicle is traveling behind another vehicle on a single lane road in a no passing zone and may set the trailing signal 284 to the first state when the vehicle has traveled behind another vehicle for at least the third predetermined period continuously. While the vehicle detection module 280 is shown and discussed as being implemented within the navigation module 182, the vehicle detection module 280 may be implemented separately, such as with the forward facing camera 188.

Figure 3:
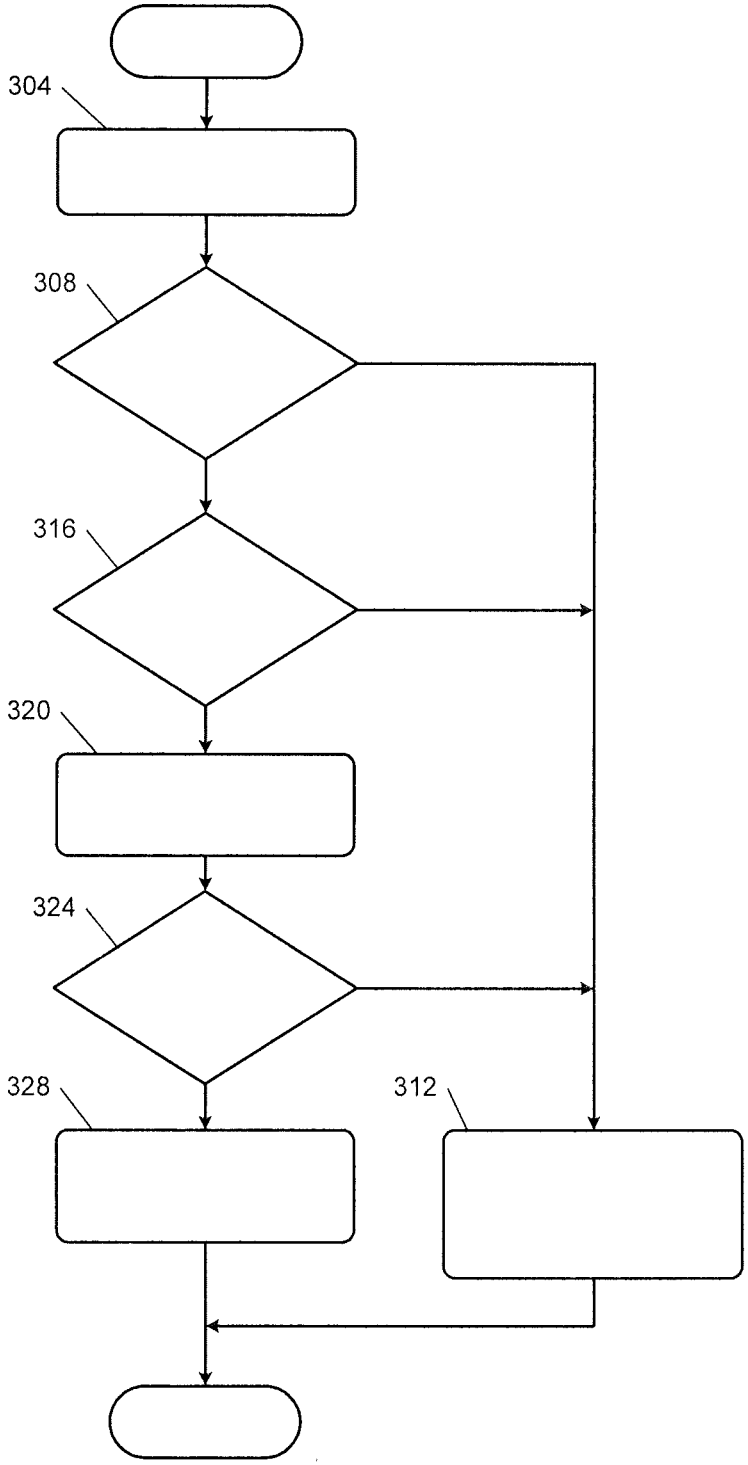
FIG. 3 is a flowchart depicting an example method of displaying a distance and/or an estimated period to a next passing zone information on a display within a passenger cabin of a vehicle.

FIG. 3 is a flowchart depicting an example method of displaying next passing zone information on the display 184. Control may begin with 304 when the vehicle is on. At 304, the GPS module 216 obtains the vehicle location 220, and the heading module 224 determines the vehicle heading 228.

At 308, the road type module 236 may determine and indicate whether the vehicle is presently on a single lane road. The road type module 236 may determine whether the vehicle is presently on a single lane road, for example, based on the vehicle location 220 using data stored in the road database 240. If 308 is false, the triggering module 268 may not trigger the display module 208, and the display module 208 may not display the next passing zone data 260, such as the driving distance to the next passing zone and/or the estimated travel period to the next passing zone, on the display 184 at 312. If 308 is true, control may continue with 316.

The passing zone module 248 may determine whether the vehicle is currently located within a no passing zone at 316. The passing zone module 248 may determine whether the vehicle is presently located within a no passing zone, for example, based on the vehicle location 220 using data stored in the passing zone database 252. If 316 is false, the triggering module 268 may not trigger the display module 208, and the display module 208 may not display the next passing zone data 260 on the display 184 at 312. If 316 is true, control may continue with 320.

At 320, the passing zone module 248 may determine the next passing zone data 260. For example, the passing zone module 248 may determine the location of the next passing zone, determine the driving distance from the vehicle location 220 to the location of the next passing zone, and determine the estimated travel period to the location of the next passing zone.

At 324, the triggering module 268 may determine whether to trigger the display module 208 to display the next passing zone data 260. If 324 is false, the display module 208 does not display the next passing zone data 260 at 312. If 324 is true, control continues with 328. For example, the triggering module 268 may trigger the display module 208 to display the next passing zone data 260 on the display 184 when:

(i) the triggering module 268 receives the user input request 276 that the next passing zone data 260 be displayed, such as via touching the display 184;

(ii) the driving distance to the next passing zone is greater than the first predetermined distance and/or the estimated travel period to the next passing zone is greater than the first predetermined travel period;

(iii) the driving distance to the next passing zone becomes less than the second predetermined driving distance and/or the estimated travel period to the next passing zone becomes less than the second predetermined period; and/or (iv) the vehicle has traveled for at least the third predetermined period behind another vehicle on the single lane road.

(iv) may include only time spent in the no passing zone or both time spent in a passing and the no passing zone.

The triggering module 268 may additionally or alternatively trigger the display module 208 to display the next passing zone data 260 on the display 184 when the vehicle speed 264 has been continuously less than a speed limit (or less than the speed limit by at least a predetermined amount) at that vehicle location on the single lane road for greater than the predetermined period. Traveling at speeds less than the speed limit may indicate that the vehicle is traveling behind a slower moving vehicle. The speed limits may be stored by vehicle location in a database and may be determined for a location using the vehicle location 220.

At 328, the display module 208 displays the next passing zone data 260, such as the estimated travel period to the next passing zone and/or the driving distance to the next passing zone, on the display 184. While control is shown as ending after 328 or 312, control may return to 304.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A passing zone display system of a vehicle, comprising:

a road type module that, based on a present location of the vehicle, determines whether the vehicle is traveling on a single lane road, the single lane road including passing zones and no passing zones, and the single lane road having only two lanes for vehicles, the two lanes including a first lane designated for travel in one direction and a second lane designated for travel in an opposite direction;

a passing zone module that, when the vehicle is traveling on the single lane road, based on the present location of the vehicle determines whether the vehicle is located in one of the passing zones or in one of the no passing zones; and a display module that:

when the vehicle is in one of the no passing zones on the single lane road, selectively displays, on a display located within a passenger cabin of the vehicle, at least one of:

a first driving distance from a present location of the vehicle to a next one of the passing zones on the single lane road in a direction of travel of the vehicle; and a first estimated driving period from the present location of the vehicle to the next one of the passing zones on the single lane road in the direction of travel of the vehicle; and when the vehicle is in the one of the no passing zones on the single lane road, selectively displaying, on the display located within the passenger cabin of the vehicle, at least one of:

a second driving distance from the present location of the vehicle to a location where the single lane road turns into a road having two or more lanes for travel in the direction of travel of the vehicle; and a second estimated driving period from the present location of the vehicle to the location where the single lane road turns into a road having two or more lanes for travel in the direction of travel of the vehicle.

2. The passing zone display system of claim 1 wherein the display module displays the at least one of the first driving distance and the first estimated driving period in response to receipt of user input to display the at least one of the first driving distance and the first estimated driving period while the vehicle is in the one of the no passing zones on the single lane road.

3. The passing zone display system of claim 2 further comprising an input module that generates the user input in response to user touching of the display.

4. The passing zone display system of claim 1 wherein the display module displays the at least one of the first driving distance and the first estimated driving period in response to the first driving distance being less than a predetermined driving distance while the vehicle is in the one of the no passing zones on the single lane road.

5. The passing zone display system of claim 1 wherein the display module displays the at least one of the first driving distance and the first estimated driving period in response to the first estimated driving period being less than a predetermined period while the vehicle is in the one of the no passing zones on the single lane road.

6. The passing zone display system of claim 1 wherein the display module displays the at least one of the first driving distance and the first estimated driving period in response to the vehicle entering the one of the no passing zones on the single lane road and a driving length of the one of the no passing zones being greater than a predetermined distance.

7. The passing zone display system of claim 1 wherein the display module displays the at least one of the first driving distance and the first estimated driving period in response to the vehicle entering the one of the no passing zones on the single lane road and the first driving distance being greater than a predetermined distance.

8. The passing zone display system of claim 1 wherein the display module displays the at least one of the first driving distance and the first estimated driving period in response to the vehicle entering the one of the no passing zones on the single lane road and the first estimated driving period being greater than a predetermined period.

9. The passing zone display system of claim 1 wherein the display module displays both:

the first driving distance to the location of the next one of the passing zones on the single lane road in the direction of travel of the vehicle; and the first estimated driving period to the location of the next one of the passing zones on the single lane road in the direction of travel of the vehicle.

10. A passing zone display method for a vehicle, comprising:

based on a present location of the vehicle, determining whether the vehicle is traveling on a single lane road, the single lane road including passing zones and no passing zones, and the single lane road having only two lanes for vehicles, the two lanes including a first lane designated for travel in one direction and a second lane designated for travel in an opposite direction;

when the vehicle is traveling on the single lane road, based on the present location of the vehicle, determining whether the vehicle is located in one of the passing zones or in one of the no passing zones;

when the vehicle is in one of the no passing zones on the single lane road, selectively displaying, on a display located within a passenger cabin of the vehicle, at least one of:

a first driving distance from a present location of the vehicle to a next one of the passing zones on the single lane road in a direction of travel of the vehicle; and a first estimated driving period from the present location of the vehicle to the next one of the passing zones on the single lane road in the direction of travel of the vehicle; and when the vehicle is in the one of the no passing zones on the single lane road, selectively displaying, on the display located within the passenger cabin of the vehicle, at least one of:

a second driving distance from to a location where the single lane road turns into a road having two or more lanes for travel in the direction of travel of the vehicle; and a second estimated driving period to the location where the single lane road turns into a road having two or more lanes for travel in the direction of travel of the vehicle.

11. The passing zone display method of claim 10 wherein the selectively displaying includes displaying the at least one of the first driving distance and the first estimated driving period in response to receipt of user input to display the at least one of the first driving distance and the first estimated driving period while the vehicle is in the one of the no passing zones on the single lane road.

12. The passing zone display method of claim 11 further comprising generating the user input in response to user touching of the display.

13. The passing zone display method of claim 10 wherein the selectively displaying includes displaying the at least one of the first driving distance and the first estimated driving period in response to the first driving distance being less than a predetermined driving distance while the vehicle is in the one of the no passing zones on the single lane road.

14. The passing zone display method of claim 10 wherein the selectively displaying includes displaying the at least one of the first driving distance and the first estimated driving period in response to the first estimated driving period being less than a predetermined period while the vehicle is in the one of the no passing zones on the single lane road.

15. The passing zone display method of claim 10 wherein the selectively displaying includes displaying the at least one of the first driving distance and the first estimated driving period in response to the vehicle entering the one of the no passing zones on the single lane road and a driving length of the one of the no passing zones being greater than a predetermined distance.

16. The passing zone display method of claim 10 wherein the selectively displaying includes displaying the at least one of the first driving distance and the first estimated driving period in response to the vehicle entering the one of the no passing zones on the single lane road and the first driving distance being is-greater than a predetermined distance.

17. The passing zone display method of claim 10 wherein the selectively displaying includes displaying the at least one of the first driving distance and the first estimated driving period in response to the vehicle entering the one of the no passing zones on the single lane road and the first estimated driving period being is greater than a predetermined period.

18. The passing zone display method of claim 10 wherein the selectively displaying includes displaying both:

the first driving distance to the location of the next one of the passing zones on the single lane road in the direction of travel of the vehicle; and the first estimated driving period to the location of the next one of the passing zones on the single lane road in the direction of travel of the vehicle.

* * * * *